US007443344B2

(12) United States Patent
Boyle

(10) Patent No.: US 7,443,344 B2
(45) Date of Patent: Oct. 28, 2008

(54) ANTENNA ARRANGEMENT AND A MODULE AND A RADIO COMMUNICATIONS APPARATUS HAVING SUCH AN ARRANGEMENT

(75) Inventor: Kevin R. Boyle, Horsham (GB)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 10/568,010

(22) PCT Filed: Aug. 4, 2004

(86) PCT No.: PCT/IB2004/002628

§ 371 (c)(1),
(2), (4) Date: Feb. 10, 2006

(87) PCT Pub. No.: WO2005/018045

PCT Pub. Date: Feb. 24, 2005

(65) Prior Publication Data

US 2006/0290569 A1 Dec. 28, 2006

(30) Foreign Application Priority Data

Aug. 15, 2003 (GB) ..... 0319211.9

(51) Int. Cl.
*H01Q 1/38* (2006.01)
*H01Q 1/24* (2006.01)
*H01Q 13/10* (2006.01)

(52) U.S. Cl. ..... 343/700 MS; 343/702; 343/770

(58) Field of Classification Search ..... 343/700 MS, 343/702, 770, 848
See application file for complete search history.

(56) References Cited

U.S. PATENT DOCUMENTS 6,624,788 B2 * 9/2003 Boyle ..... 343/702
6,759,991 B2 * 7/2004 Boyle ..... 343/702

FOREIGN PATENT DOCUMENTS

FI EP 1304765 A2 * 4/2003

* cited by examiner

*Primary Examiner*—Shih-Chao Chen

(57) ABSTRACT

An antenna arrangement for a radio communications apparatus such as a mobile phone, comprises a substantially planar patch conductor having a first feed connection point for connection to radio circuitry and a second feed connection point for connection to a ground plane, a first, differential slot in the patch conductor between the first and second connection points and a second, dual band slot located in the patch conductor outside the area between the first and second connection points. The length of the first slot is greater than a quarter wavelength, and provides a third resonant frequency increasing the bandwidth of the antenna. The width of the patch conductor between the first and the second slots is selected to obtain a low impedance transformation and thereby a low antenna resistance causing detuning the antenna. A user holding the phone increases the antenna resistance thereby tuning the antenna.

7 Claims, 4 Drawing Sheets

Figure 1:
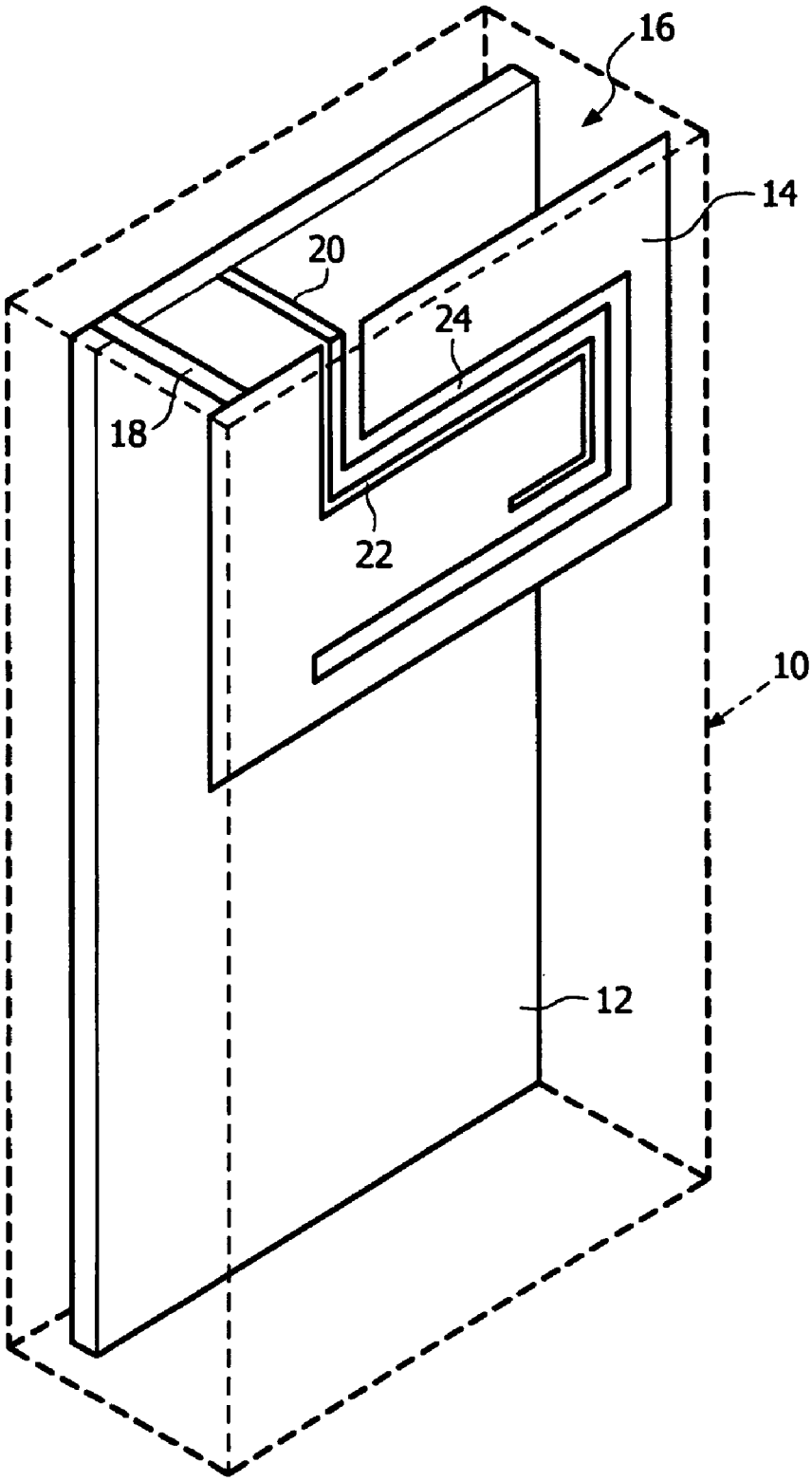

ANTENNA ARRANGEMENT AND A MODULE AND A RADIO COMMUNICATIONS APPARATUS HAVING SUCH AN ARRANGEMENT

The present invention relates to an antenna arrangement comprising a substantially planar patch conductor, a module and a radio communications apparatus incorporating such an arrangement.

Modern mobile phone handsets typically incorporate an internal antenna, such as a Planar Inverted-F Antenna (PIFA) or similar. PIFAs are popular in mobile phone handset because they exhibit low SAR and they are installed above the phone circuitry and, therefore, make fuller use of the space within the phone casing.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Further, PIFAs become reactive at resonance as the patch height is increased, which is necessary to improve bandwidth.

A further problem occurs when a dual band antenna is required. In this case two resonances are required from a single structure, which usually requires a compromise to be made between the two bands.

Our co-pending PCT Patent Application 02/060005 discloses a variation on a conventional PIFA in which a slot is introduced in the PIFA between the feed pin and shorting pin. Such an arrangement provided an antenna having substantially improved impedance characteristics while requiring a smaller volume than a conventional PIFA.

Our co-pending PCT Patent Application 02/071535 discloses an antenna arrangement comprising a relatively small patch conductor supported substantially parallel to a ground plane. The patch conductor includes first and second connection points, for connection to radio circuitry and a ground plane, and further incorporates a slot between the first and second points. The antenna can be operated in a plurality of modes by variations in the impedances connected to the first and second points. For example, if signals are fed to the first point then a high frequency antenna is obtained by connecting the second point to ground and a low frequency antenna by leaving the second point open circuit. Various other alternative connection arrangements are also disclosed. In one of these alternative arrangements a third connection point is provided together with a second, differential slot between the second and third connection points. The second slot, which functions to control impedance, has a length of the order of a quarter wavelength and, because the patch conductor is small, it extends close to the edge of the patch conductor. The presence of this second slot enables the low frequency mode to operate as a differentially slotted PIFA with improved impedance characteristics.

A problem with mounting PIFAs just inside the outer surface of the phone casing is that they are very susceptible to user detuning. Detuning causes the antenna resistance to increase at both the relatively low GSM and the relatively high DCS frequencies of approximately 900 MHz and 1.8 GHz, respectively. This detuning causes a loss of radiated power and degrades the performance of the radio.

An object of the present invention is to mitigate user detuning of the planar antenna arrangement.

According to a first aspect of the present invention there is provided an antenna arrangement comprising a substantially planar patch conductor having a first feed connection point for connection to radio circuitry and a second feed connection point for connection to a ground plane, a first, differential slot in the patch conductor between the first and second connection points and a second, dual band slot located in the patch conductor outside the area between the first and second connection points, wherein the length of the first slot is such as to provide an additional resonance.

According to a second aspect of the present invention there is provided a module comprising a printed circuit board (PCB) providing a ground plane, radio circuitry mounted on the PCB, and an antenna arrangement, the antenna arrangement comprising a substantially planar patch conductor having a first feed connection point for connection to the radio circuitry and a second feed connection point for connection to the ground plane, a first, differential slot in the patch conductor between the first and second connection points and a second, dual band slot located in the patch conductor outside the area between the first and second connection points, wherein the length of the first slot is such as to provide an additional resonance.

According to a third aspect of the present invention there is provided a radio communications apparatus comprising a casing containing a printed circuit board (PCB) providing a ground plane, radio circuitry mounted on the PCB, and an antenna arrangement, the antenna arrangement comprising a substantially planar patch conductor having a first feed connection point for connection to the radio circuitry and a second feed connection point for connection to the ground plane, a first, differential slot in the patch conductor between the first and second connection points and a second, dual band slot located in the patch conductor outside the area between the first and second connection points, wherein the length of the first slot is such as to provide an additional resonance.

By having an additional resonance, it is possible to increase the bandwidth of the antenna arrangement by combining the additional resonance with another resonance.

The first slot also provides impedance control which improves user interaction.

The present invention is based on the realisation that fundamentally a PIFA and handset PCB (printed circuit board)/case acts a series resonant structure. Hence, for a given system impedance, $Z_0$, and required antenna transmission coefficient, $|\tau|^2$, it can be shown that the bandwidth is maximum when the antenna resistance at resonance is given by $$R = \frac{Z_0}{\frac{2}{|\tau|^2} - 1}$$

By way of example consider an antenna that is required to be matched with a return loss of better than −6 dB to a system impedance of 50 Ω. The optimum antenna resistance is calculated as 30 Ω.

Since this resistance is lower than the system impedance, using it would give some resilience to user detuning, which tends to increase the antenna resistance towards the system impedance. There may also be an advantage in having yet a lower antenna resistance to allow for high levels of user detuning. The effect of the user also tends to increase the antenna bandwidth.

A practical problem associated with PIFAs is that the feed and shorting pins act as an upwards impedance transforming network. In the antenna arrangement made in accordance with the present invention a low transformation factor, and, hence, a low antenna resistance is produced by providing a differential slot between the feed and shorting pins in the antenna top plate. However by making the differential slot longer than is used the antenna arrangement disclosed in PCT Patent Application 02/071535, say a length greater than a quarter wavelength, for example a half wavelength, the slot itself resonates and introduces a third resonance which provides the additional advantage of increasing the bandwidth of the antenna. For example the antenna arrangement can have resonances at the GSM, DCS and UMTS frequencies. If the differential slot is extended further the third resonance decreases in frequency so that together with the second resonance, a wide resonant band is created which covers DCS 1800, PCS 1900 and UMTS bands simultaneously.

Figure 2:
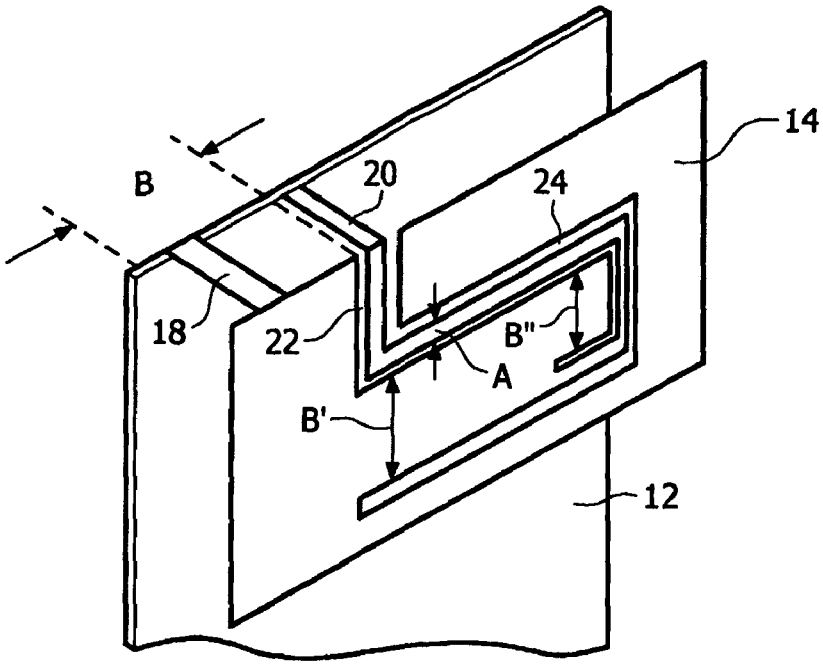
Figure 3:
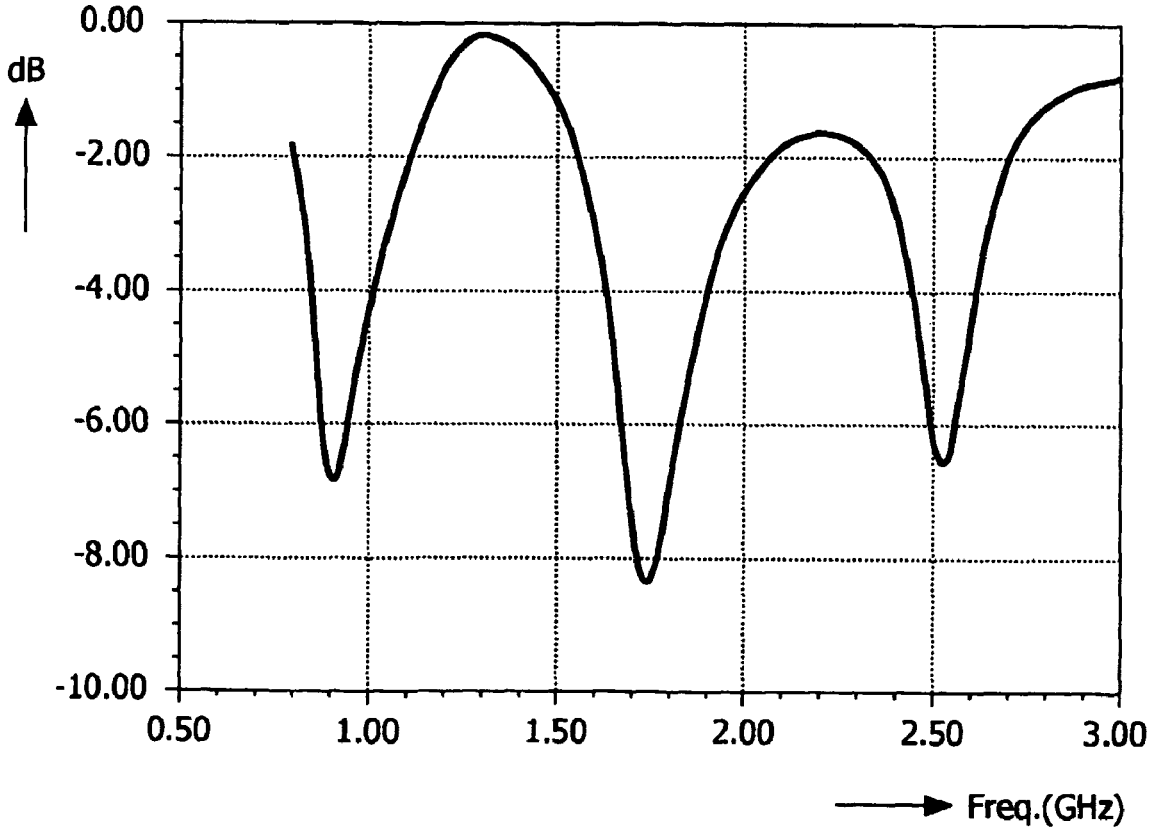
Figure 4:
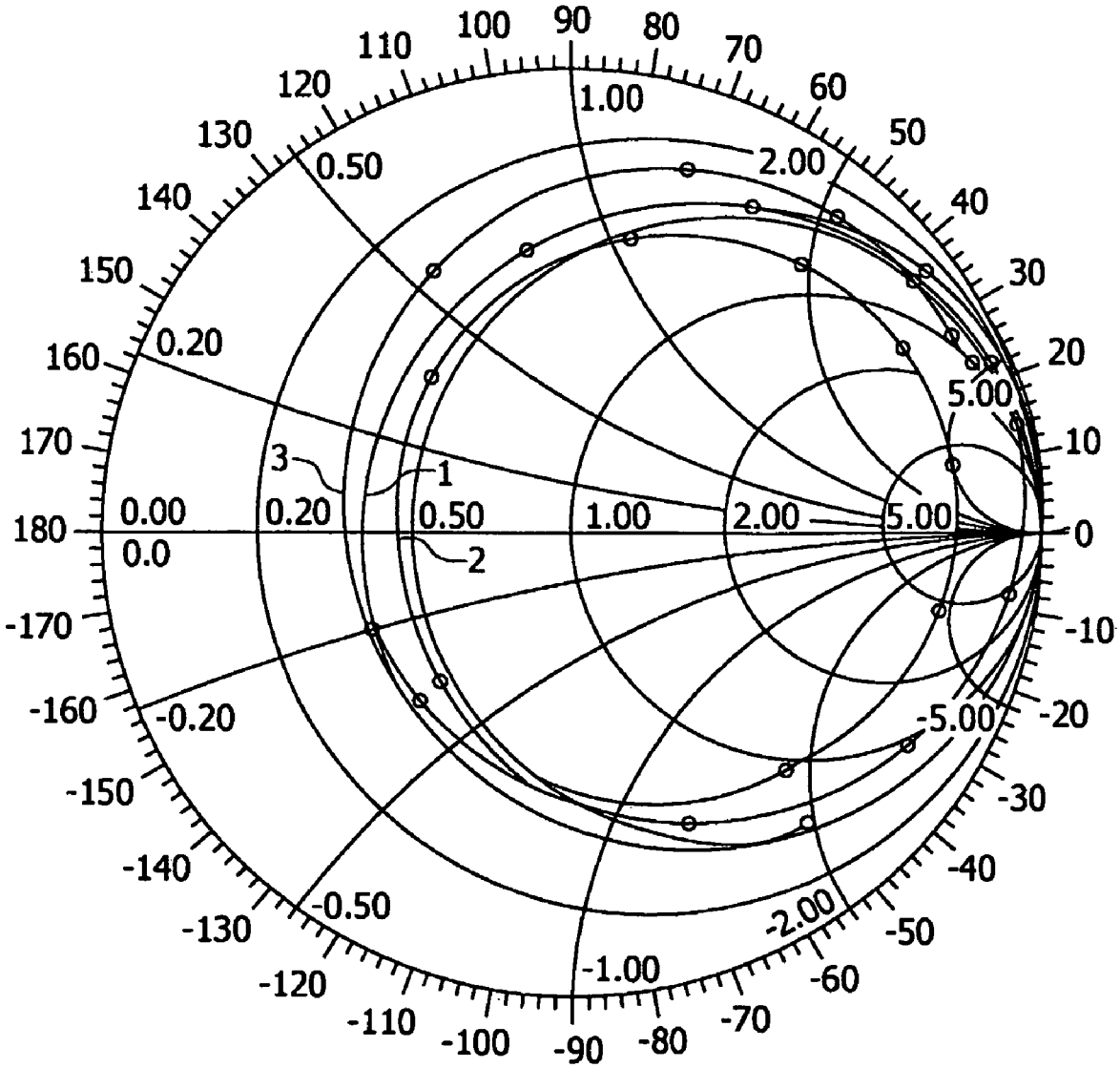
Figure 5:
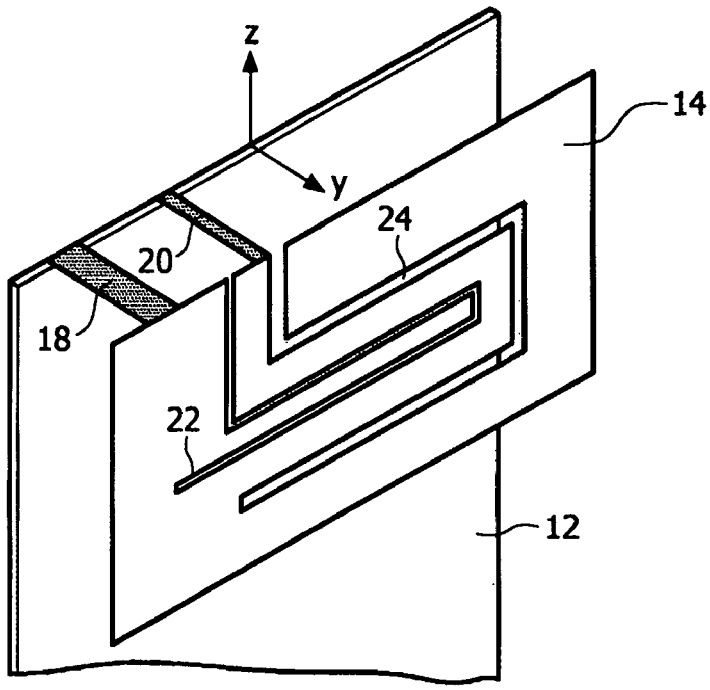
Figure 6:
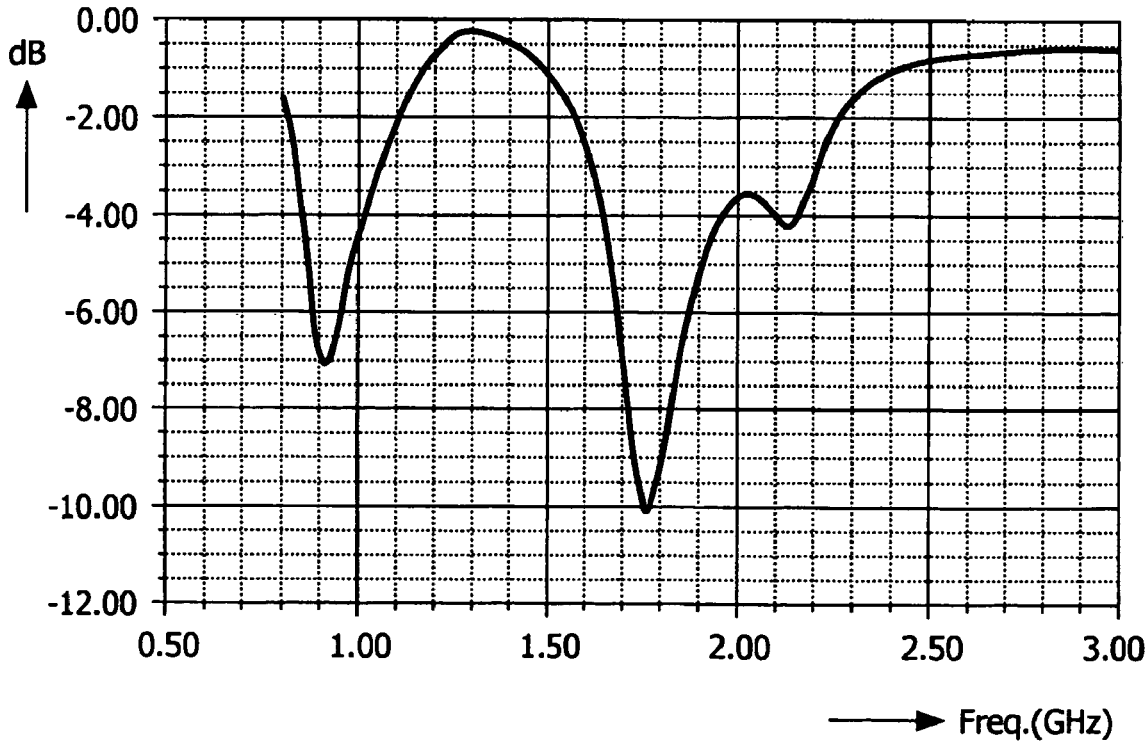

The present invention will now be described, by way of example, with reference to the accompanying drawings, wherein:

FIG. 1 is a diagrammatic perspective view of a radio communications apparatus, FIG. 2 is a perspective view of one embodiment of a PIFA arrangement made in accordance with the present invention, FIG. 3 is a $S_{11}$ plot of the PIFA arrangement shown in FIG. 2, FIG. 4 is a Smith chart relating to the arrangement shown in FIG. 2, FIG. 5 is a perspective view of a second embodiment of a PIFA arrangement made in accordance with the present invention, and FIG. 6 is a $S_{11}$ plot of the PIFA arrangement shown in FIG. 5.

In the drawings the same reference numerals have been used to indicate corresponding features.

The radio communications apparatus shown in FIG. 1 comprises a casing 10, shown in broken lines, which contains a printed circuit board (PCB) 12 carrying radio circuit components (not shown) on both sides and having a ground plane (not shown) covering those areas of the surfaces not having components mounted thereon. A planar patch antenna 14, for example, a Planar Inverted F Antenna (PIFA), is mounted inside the casing and is separated from the PCB by a dielectric 16 which in the illustrated embodiment is air. A feed pin 18 and a shorting pin 20 are connected between respective connection points on the PCB 12 and the antenna 14. The feed pin 18 is laterally spaced from the shorting pin 20.

The antenna 14, which may be fabricated in anyone of several known ways, for example from metal sheet or as a metal layer on a substrate, is substantially the width of the PCB 12. A differential slot 22 is provided in the patch antenna and opens into the edge of the antenna at a point between the feed and shorting pins. The slot 22 which comprises a plurality of intercommunicating rectilinear sections has a length of between a quarter and a half of a wavelength. A dual band slot 24 is provided in the antenna 14 and opens into the edge of the antenna at a location beyond the area bounded by the feed and shorting pins. The slot 24, which is of similar shape to the slot 22, extends parallel to, and at a constant space from, the slot 22. The length of the slot 24 is selected to be greater than a quarter of a wavelength at 1.8 GHz and less than a quarter wavelength at 900 MHz.

FIG. 2 shows the antenna 14 in slightly greater detail. The ratio of the dimensions A and B controls the impedance tranformation. The value of B varies along the length of the slot 22, see for example B' and B", and in any impedance calculation the ratio A/B used in calculating impedance is averaged over the length of the slot 22. When A is small the impedance transformation is low.

The slot 22 between the feed and shorting pins 18, 20 introduces a third resonance that occurs when the slot is between approximately $\lambda/4$ and $\lambda/2$ long. Here the slot is approximately 40 mm long, giving resonance at approximately 2.5 GHz. This is shown in FIGS. 3 and 4. In FIG. 3 the resonances are shown at approximately 900 MHz, 1.75 GHz and 2.5 GHz. In the Smith chart shown in FIG. 3 markers 1, 2 and 3 are at 920, 1740 and 2540 MHz respectively. Hence, this configuration can cover the GSM high and low frequency bands and a third, higher frequency, band. The high frequency resonance may be used to cover Bluetooth or IEEE 802.11b at 2.4 to 2.5 GHz, TD-SDCMA at 2.3 to 2.4 GHz, UMTS future expansion at 2.5 to 2.7 GHz and so on. FIG. 4 also shows that all 3 resonances can be matched simultaneously to a deliberately low impedance, in order to account for the effects of user detuning. If the differential slot 22 was not present the $S_{11}$ plot on the Smith chart would move inductively. The slot 22 counters this effect and reduces the resistance on-axis. The effect of a user picking up the phone moves the $S_{11}$ plot back to the middle, that is to 1.00.

The second embodiment of the invention shown in FIG. 5 differs from that shown in FIG. 2 by the slot 22 being extended further. The length of the dual band slot 24 remains the same. The effect of extending the slot 22 is to combine the second an third resonances to give a wider second resonance.

This allows the DCS1800, PCS1900 and UMTS bands to be simultaneously covered.

The $S_{11}$ of the configuration shown in FIG. 5 is given in FIG. 6. Once again the resistance is deliberately low to allow for user interaction. Control over resistance is possible by way of the position of the slot 22. However, it can clearly be seen that the upper frequency band is now very wide.

Various modifications can be made to the illustrated antennas, for example the slots 22, 24 could have more meanders and/or have other directions. However the length of the slot 22 still determines the third resonance and the ratio A/B (FIG. 2) still determines the impedance.

In the present specification and claims the word "a" or "an" preceding an element does not exclude the presence of a plurality of such elements. Further, the word "comprising" does not exclude the presence of other elements or steps than those listed.

From reading the present disclosure, other modifications will be apparent to persons skilled in the art. Such modifications may involve other features which are already known in the design, manufacture and use of planar antenna arrangements and component parts therefor and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

The invention claimed is:

1. An antenna arrangement comprising a substantially planar patch conductor having a first feed connection point for connection to radio circuitry and a second feed connection point or connection to a ground plane, a first, differential slot in the patch conductor between the first and second connection points and a second, dual band slot located in the patch conductor outside the area between the first and second connection points, wherein the length of the first slot is such as to provide an additional resonance, and the width of the patch conductor between the first and the second slots is selected to give an impedance less than a system impedance.

2. An antenna arrangement as claimed in claim 1, wherein the length of the first slot is greater than a quarter wavelength.

3. An antenna arrangement as claimed in claim 1, wherein the length of the first slot is such that the additional resonance combines with an adjacent resonance.

4. A module comprising a printed circuit board providing a ground plane, radio circuitry mounted on the PCB, and an antenna arrangement, the antenna arrangement comprising a substantially planar patch conductor having a first feed connection point for connection to the radio circuitry and a second feed connection point for connection to the ground plane, a first, differential slot in the patch conductor between the first and second connection points and a second, dual band slot located in the patch conductor outside the area between the first and second connection points, wherein the length of the first slot is such as to provide an additional resonance, and the width of the patch conductor between the first and the second slots is selected to give an impedance less than a system impedance.

5. A module as claimed in claim 4, wherein the length of the first slot is greater than a quarter wavelength.

6. A module as claimed in claim 4, wherein the length of the first slot is such that the additional resonance combines with an adjacent resonance.

7. A radio communications apparatus comprising a casing containing a printed circuit board providing a ground plane, radio circuitry mounted on the printed circuit board, and an antenna arrangement, the antenna arrangement comprising a substantially planar patch conductor having a first feed connection point for connection to the radio circuitry and a second feed connection point for connection to the ground plane, a first, differential slot in the patch conductor between the first and second connection points and a second, dual band slot located in the patch conductor outside the area between the first and second connection points, wherein the length of the first slot is such as to provide an additional resonance, and the width of the patch conductor between the first and the second slots is selected to give an impedance less than a system impedance.

* * * * *